US007071621B1

(12) United States Patent
Namiki et al.

(10) Patent No.: US 7,071,621 B1
(45) Date of Patent: Jul. 4, 2006

(54) COLOR PLASMA DISPLAY PANEL WITH PIXELS OF THREE COLORS HAVING ADJUSTABLE LIGHT INTENSITIES

(75) Inventors: Fumihiro Namiki, Kawasaki (JP); Katsuya Irie, Kawasaki (JP); Tadayoshi Kosaka, Kawasaki (JP); Kazushige Takagi, Kawasaki (JP); Takashi Shiizaki, Kawasaki (JP); Hitoshi Hirakawa, Kawasaki (JP); Takashi Katayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/460,459

(22) Filed: Dec. 13, 1999

(30) Foreign Application Priority Data

Feb. 19, 1999 (JP) ..... 11-040837
Jun. 30, 1999 (JP) ..... 11-184609

(51) Int. Cl.
*H01J 17/49* (2006.01)
*H01J 11/02* (2006.01)

(52) U.S. Cl. ..... 313/584; 313/485; 313/582; 313/585; 313/586

(58) Field of Classification Search ..... 313/491, 313/484, 582–587
See application file for complete search history.

(56) References Cited

U.S. PATENT DOCUMENTS 5,587,624 A 12/1996 Komaki
5,742,122 A * 4/1998 Amemiya et al. ..... 313/485
5,818,168 A 10/1998 Ushifusa et al.
5,838,106 A * 11/1998 Funada ..... 313/112
5,952,782 A * 9/1999 Nanto et al. ..... 313/582
6,008,582 A 12/1999 Asano et al.
6,232,717 B1 * 5/2001 Oida et al. ..... 313/112
6,348,762 B1 * 2/2002 Nunomura et al. ..... 313/582
6,642,653 B1 * 11/2003 Hirano et al. ..... 313/582

FOREIGN PATENT DOCUMENTS

| | | |
|---|---|---|
| EP | 0 966 017 | 12/1999 |
| JP | 05-258672 | 10/1993 |
| JP | 8-190869 | 7/1996 |
| JP | 08304807 A * | 11/1996 |
| JP | 10-092326 | 4/1998 |
| JP | 10-208645 | 8/1998 |
| JP | 10-228870 | 8/1998 |
| JP | 10-247458 | 9/1998 |
| JP | 10-269949 | 10/1998 |
| JP | 10-308179 | 11/1998 |
| JP | 10-308180 | 11/1998 |
| JP | 11-7896 | 1/1999 |
| JP | 11-67099 | 3/1999 |
| JP | 2000-123748 | 4/2000 |
| JP | 2000-228150 | 8/2000 |
| WO | 97/11477 | 3/1997 |

OTHER PUBLICATIONS

Partial Translation of JP10–247458 to Eiichiro (previously submitted).

* cited by examiner

*Primary Examiner*—Karabi Guharay
*Assistant Examiner*—Sikha Roy
(74) *Attorney, Agent, or Firm*—Staas & Halsey LLP

(57) ABSTRACT

A plasma display panel is provided in which color temperature of the displayed color can be optimized while securing the gradation reproducibility and the stability of driving. The plasma display panel includes a screen in which a plurality of cells arranged in rows and columns emits light by electric discharge between a pair of main electrodes, and each pixel of matrix display has first, second and third cells having different light colors. At least one of the effective area of the main electrode, the thickness of the dielectric layer, the relative dielectric constant of the dielectric material, and the area of the light shield for the first cell is different from that of the second cell.

26 Claims, 17 Drawing Sheets

COLOR PLASMA DISPLAY PANEL WITH PIXELS OF THREE COLORS HAVING ADJUSTABLE LIGHT INTENSITIES

BACKGROUND OF THE INVENTION

1. Field of the Invention

The present invention relates to a plasma display panel (PDP) that can perform color display.

A PDP is becoming widely available as a wide screen display for a television set after the color display thereof has been succeeded in commercialization. One of the challenges to improve the image quality of the PDP is to enhance reproducible color range.

2. Description of the Prior Art

As a color display device, an AC type PDP having three-electrode surface discharging structure is commercialized. This type has a pair of main electrodes for sustaining, which are arranged in parallel for each line (row) of the matrix display and also has an address electrode for each column. Division walls for preventing interruption of discharge between cells are provided in stripes. A surface discharging structure includes a substrate on which the pairs of main electrodes are arranged and an opposing substrate on which a fluorescent layer for color display is arranged, so that deterioration of a fluorescent layer due to an ion impact upon discharge can be reduced to obtain a longer life. The "reflection type" that has the fluorescent layer on the back substrate is superior to the "transparent type" that has the fluorescent layer on the front substrate concerning light emission efficiency. In general, Penning gas containing neon (Ne) and a trace of xenon (Xe) (4–5%) is used as a discharging gas. When the discharge between main electrodes occurs, the discharging gas radiates ultraviolet rays, which excite the fluorescent material to emit light. Each pixel includes three cells for red (R), green (G) and blue (B) light colors, and the ratio of the three light colors decide the display color. The amount of light emission of each cell depends on the number of discharge times per unit time.

The conventional PDP has a problem in that the color temperature of white is low compared with other displays (especially with a CRT). The reason is that the light intensity of the blue fluorescent material is lower than the light intensities of the red and the green fluorescent materials, and that the neon as the discharging gas emits orange light.

It is necessary to optimize the relative light intensities (balance of luminous intensities) of the R, G and B cells for obtaining a desired color tone when trying to display white color by applying the same number (the maximum number within variable range) of voltage pulses to the R, G and B cells.

There is a method for adjusting the luminous intensity, in which a conversion efficiency of the fluorescent material, the thickness or the shape of the fluorescent layer is selected. However, this method has the following problems.

1) It is not easy to adjust the conversion efficiency of the fluorescent material.

2) The thickness or the shape of the fluorescent layer can be adjusted only within the range that does not affect the discharge.

3) The control of the thickness and the shape of the fluorescent layer has low repeatability.

In addition, in order to set the number of voltage pulses to apply, that is, the number of discharges for each color so as to display white color having a desired tone, the number of voltage pulses for the color with the minimum intensity should be maximized and the number of voltage pulses for other colors should be smaller than that. Therefore, the variable range of the light emission amount is narrowed, resulting in deterioration of the gradation reproducibility.

Furthermore, there is another method in which the area of the fluorescent layer is selected for each color. In this method, stable driving is difficult since the size of the cell depends on the color, and the margin of the driving voltage is narrowed. Namely, if the size of pixel is fixed when the cells have different sizes, the cell size of at least one color becomes small compared with the cell size that is the same for three colors. Since the firing potential rises when the cell size is reduced, the voltage margin is narrowed.

SUMMARY OF THE INVENTION

The object of the present invention is to secure the gradation reproducibility and stability of driving while optimizing the color temperature of the display color.

In the first aspect of the present invention, the PDP includes a screen in which a plurality of cells arranged in rows and columns emits light by electric discharge between a pair of main electrodes, and each pixel of matrix display has first, second and third cells having different light colors. The effective area of the main electrode of the first cell is different from that of the main electrode of at least the second cell.

In the second aspect of the present invention, the PDP includes a screen in which a plurality of cells arranged in rows and columns emits light by electric discharge between a pair of main electrodes that is covered by a dielectric layer, and each pixel of matrix display has first, second and third cells having different light colors. The thickness of the dielectric layer of the first cell is different from that of the dielectric layer of at least the second cell.

In the third aspect of the present invention, the PDP includes a screen in which a plurality of cells arranged in rows and columns emits light by electric discharge between a pair of main electrodes that is covered by a dielectric layer, and each pixel of matrix display has first, second and third cells having different light colors. The relative dielectric constant of the dielectric layer of the first cell is different from that of the dielectric layer of at least the second cell.

In the fourth aspect of the present invention, the PDP includes a screen in which a plurality of cells arranged in rows and columns emits light by electric discharge between a pair of main electrodes that extend in the same direction, and each pixel of matrix display has first, second and third cells having different light colors. One pair of the main electrodes is arranged for each row, a dark color layer for enhancing contrast is disposed at each boundary between neighboring rows, and the area of the dark color layer of the first cell is different from that of the dark color layer of at least the second cell. Concerning the first and second cells, the case is included where the area of the dark color layer is zero.

In the fifth aspect of the present invention, the main electrode includes a transparent conductive film and a banding metal film overlaying the transparent conductive film, and the area of the metal film of the first cell is different from that of the metal film of at least the second cell.

In the sixth aspect of the present invention, the main electrode includes a transparent conductive film and a banding metal film overlaying the transparent conductive film, and the relative portion of the metal film to the transparent conductive film of the first cell is different from that of the metal film to the transparent conductive film of at least the second cell.

In the seventh aspect of the present invention, at least the first cell has a light shield that makes the aperture ratio thereof different from that of the other cell.

In the eighth aspect of the present invention, the main electrode includes a transparent conductive film and a banding metal film overlaying the transparent conductive film, one pair of the main electrodes is arranged for each row, a dark color layer for enhancing contrast is disposed at each boundary between neighboring rows, the area of the metal film of the first cell is different from that of the metal film of at least the second cell, and the area of the dark color layer of the first cell is different from that of the dark color layer of at least the second cell.

In the ninth aspect of the present invention, division walls for partitioning the first, second and third cells are provided on a back substrate, and the amount of light shielding for each light color is set by selecting the structure of the light shielding within the range 5 microns away from the top face of the division wall in each of the first, second and third cells.

DESCRIPTION OF THE PREFERRED EMBODIMENTS

Hereinafter, the present invention will be explained more in detail with reference to embodiments and drawings.

Figure 1:
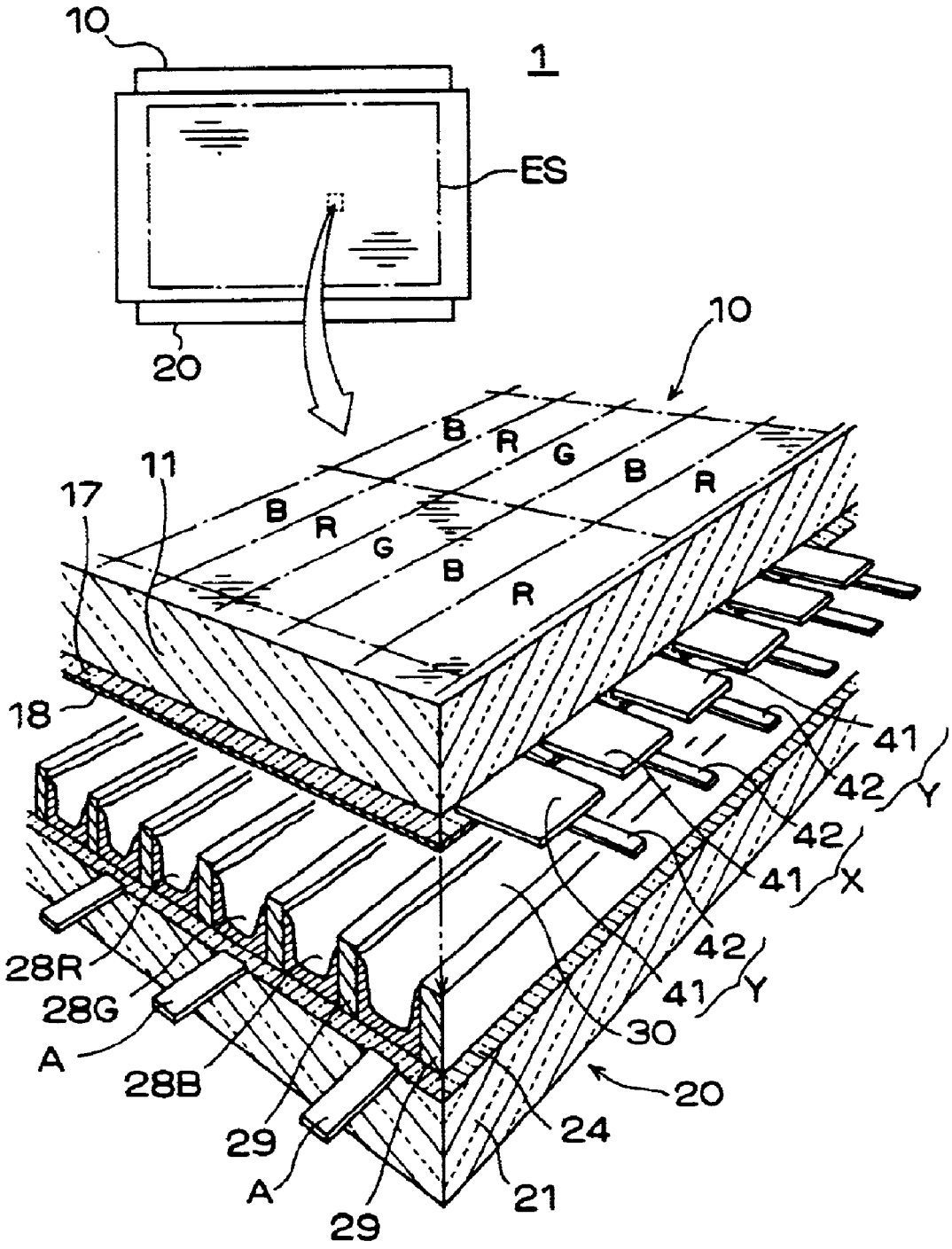
FIG. 1 shows a basic structure of a first PDP in accordance with the present invention.

FIG. 1 shows a basic structure of a first PDP in accordance with the present invention.

The illustrated PDP 1 is an AC type color PDP with a surface discharging configuration having a pair of substrate structures 10, 20. In each cell making up a screen ES, a pair of banding main electrodes X and Y and an address electrode A cross each other. The main electrodes X and Y are arranged on the inner side of a glass substrate 11 that is a front substrate structure 10. Each of the main electrodes X and Y includes a transparent conductive film 41 and a metal film (a bus electrode) 42 for securing conductivity. The metal film 42 is made up of three layers such as chromium, copper and chromium, which are laminated in the middle portion in the column direction of the transparent conductive film 41. Covering the main electrodes X and Y, a dielectric layer 17 is provided, which has thickness of 30–50 microns. The surface of the dielectric layer 17 is coated with magnesia (MgO) that is a protection film 18.

The address electrodes A are arranged on the inner surface of a glass substrate 21 that is a substrate of the back substrate structure 20, and covered with a dielectric layer 24. On the dielectric layer 24, one division wall 29 having height of 100–200 microns (typically 150 microns) is disposed at each gap between the address electrodes A. The division walls 29 partition a discharging space 30 in the row direction (the horizontal direction in the screen) for each column, and define the gap size of the discharging space 30. Furthermore, three color (R, G and B) fluorescent layers 28R, 28G and 28B for color display are provided so as to cover the back inner surface including the upper portion of the address electrode A and the side of the division wall 29. Discharging gas that is a mixture of neon as a main gas and xenon is filled in the discharging space 30, and the fluorescent layers 28R, 28G and 28B emit light being exited partially by ultraviolet rays radiated by the xenon gas. One pixel of the display includes three subpixels (units of light emitting area) arranged in the row direction. A structure in each subpixel is a cell (display element) C. Since the arrangement pattern of the division walls 29 is a stripe pattern, the portion of the discharging space 30 corresponding to each column (a column space) is continuous over the all rows. Therefore, uniform fluorescent layers 28R, 28G and 28B having little bubbles can be formed by screen printing that is suitable for mass production. Here, a row is a set of cells having the same position in the column direction.

Hereinafter, an example of configuration for relatively enhancing the luminous intensity of the blue (B) fluorescent layer 28B is explained. However, the color to be enhanced is not limited to the blue. The similar effect can be obtained if the color is red (R) or green (G). In addition, it is possible to enhance plural colors, as well as to change ratio of enhancing the colors. In the attached figures, the main electrodes and the cells are accompanied with the same reference numerals despite of different configurations.

Figure 2:
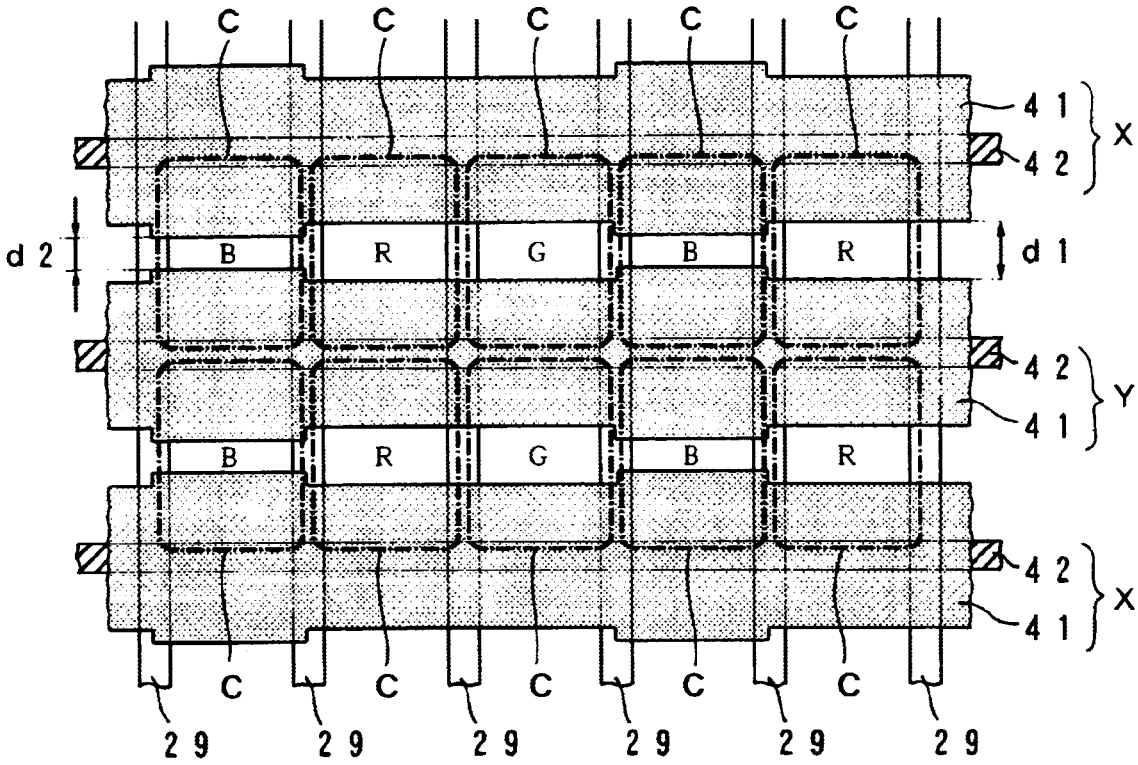
FIG. 2 is a plan view showing the shape of the main electrode.

FIG. 2 is a plan view showing the shape of the main electrode.

Each of the main electrodes X and Y includes the transparent conductive film 41 and the metal film 42 as explained above. Since the metal film 42 is completely overlapped with the transparent conductive film 41 within the screen, the shape of the transparent conductive film 41 viewed from above is also that of the main electrode X or Y. The main electrodes X and Y are arranged substantially in a constant pitch. The main electrodes X and Y except both ends of the arrangement are used for both displays of odd and even rows. The main electrodes X and Y of the both ends are used for a display of odd or even row. The structure of rectangular area defined by the division walls 29 and the metal films 42 is the cell C. The gap between the main electrodes in each cell C is the surface discharging gap.

In the example of FIG. 2, the width of the main electrodes X and Y (i.e., the width of the transparent conductive film 41) is not constant, but is partially wide so that the interelectrode gap d2 in the cell C of the blue (B) light color is smaller than the interelectrode gap d1 in the other cells. Thus, the effective area of the main electrode related to the sustaining is larger in the cell C of the blue light color than in the other cells. Therefore, the discharge having large current density occurs in the cell C, so that the luminous intensity increases. Since the main electrodes X and Y are formed by lithography, high accuracy patterning is possible.

FIGS. 3A to 8 are plan views showing variations of the shape of the main electrode.

Figure 3A:
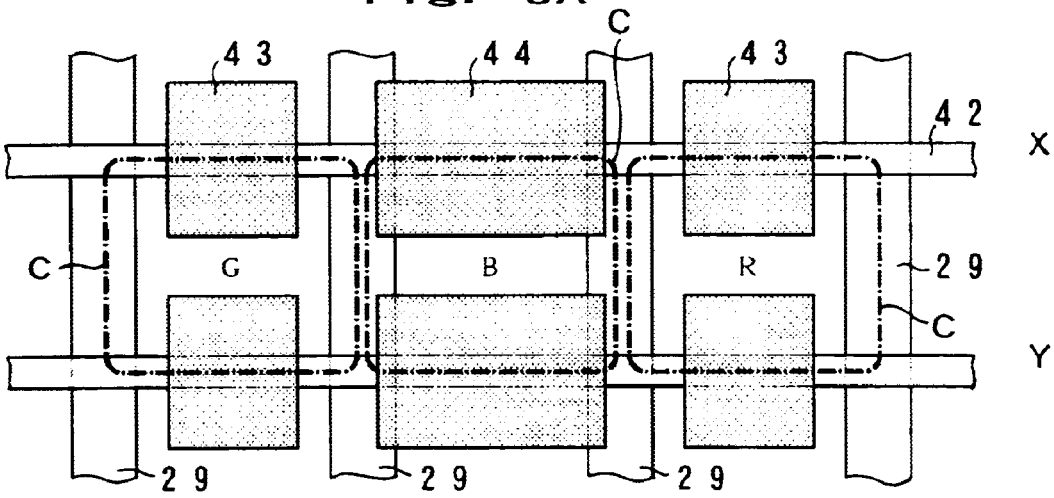
FIGS. 3A–3C, 4A–4C, 5A, 5B, 6, 7 and 8 are plan views showing variations of the shape of the main electrode.

In the example of FIG. 3A, each of the main electrodes X and Y include a banding metal film 42 and transparent conductive film 43 or 44 that has a rectangular shape and is disposed for each cell. In the cell C of blue light color, the length in the row direction of the transparent conductive film 44 is set longer than the transparent conductive film 43 of other two colors, so that the effective area of the main electrode is enlarged.

Figure 3B:
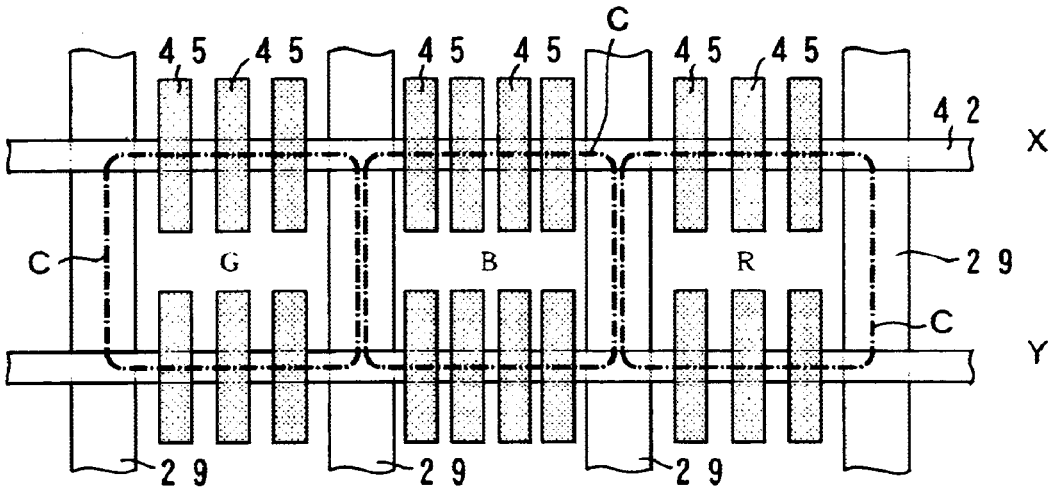

In the example of FIG. 3B, each of the main electrodes X and Y includes a banding metal film 42 and a strip transparent conductive film 45 that is long in the column direction. In the cell C of blue light color, the transparent conductive films 45 are disposed more than in other two colors, so that the effective area of the main electrode is enlarged.

Figure 3C:
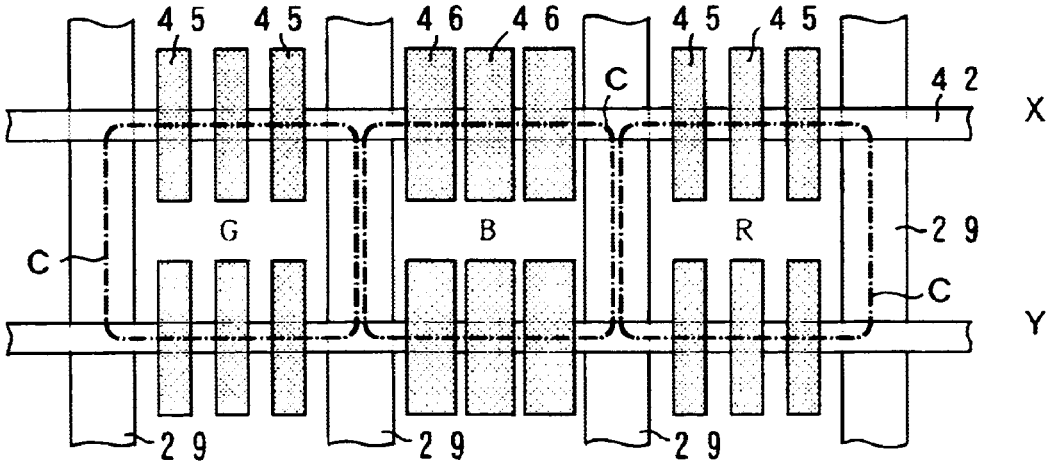

In the example of FIG. 3C, each of the main electrodes X and Y includes a banding metal film 42 and a strip transparent conductive films 45 and 46 that are long in the column direction. In the cell C of blue light color, the wider transparent conductive film 46 is disposed compared with other two colors, so that the effective area of the main electrode is enlarged.

Figure 4A:
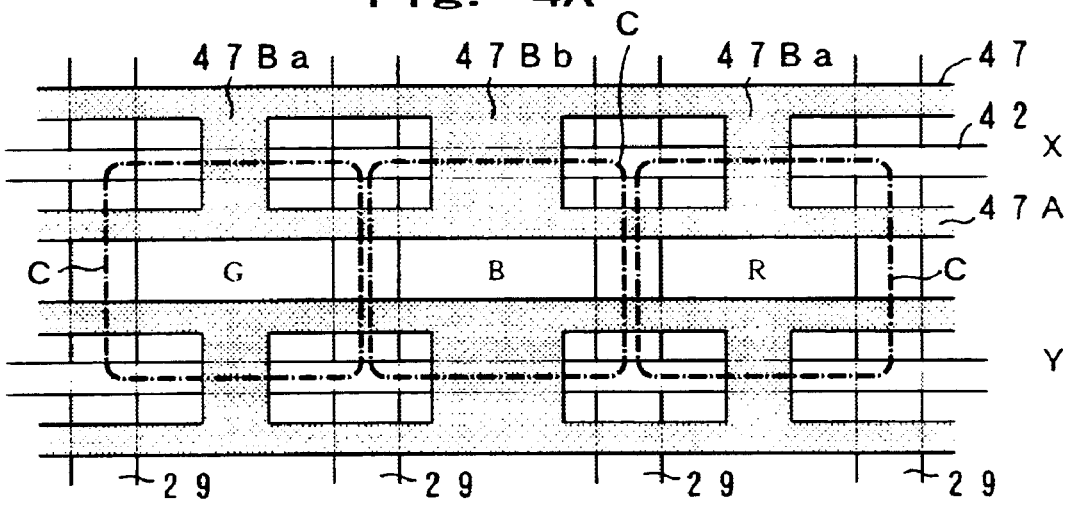

In the example of FIG. 4A, each of the main electrodes X and Y includes a banding metal film 42 and a ladder-like transparent conductive film 17. The transparent conductive film 47 has two banding portions 47A extending in parallel in the row direction and banding portions 47Ba and 47Bb extending in the column direction in each column so as to link the banding portions 47A. In the cell C of blue light color, the width of the banding portion 47Bb corresponding thereto is set wider than the banding portion 47Ba corresponding to the cells C of the other two colors, so that the effective area of the main electrode is enlarged.

Figure 4B:
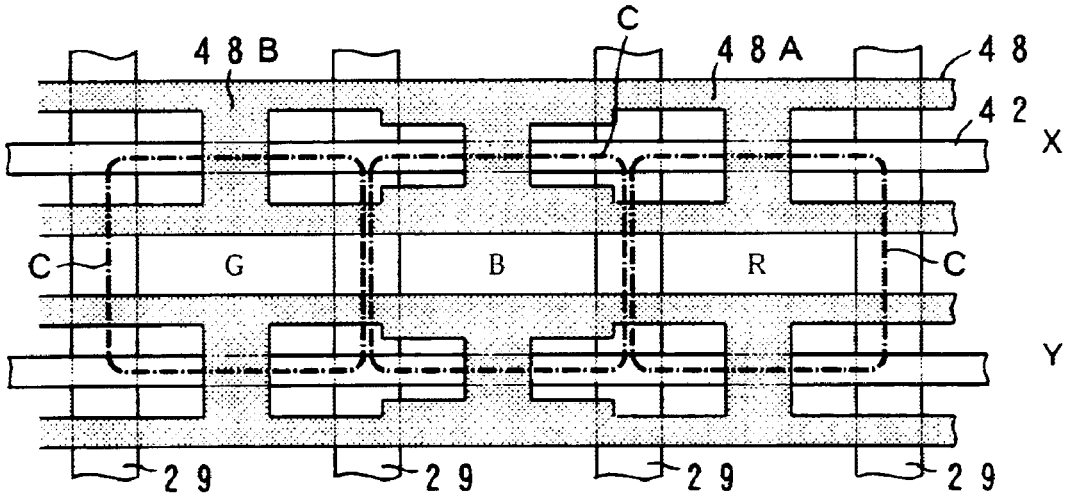

In the example of FIG. 4B, each of the main electrodes X and Y includes a banding metal film 42 and a ladder-like transparent conductive film 48. The transparent conductive film 48 has two banding portions 48A extending in parallel in the row direction and banding portion 48B extending in the column direction in each column so as to link the banding portions 48A. In the cell C of blue light color, the width of the banding portion 48A is partially enlarged, so that the effective area of the main electrode is enlarged.

Figure 4C:
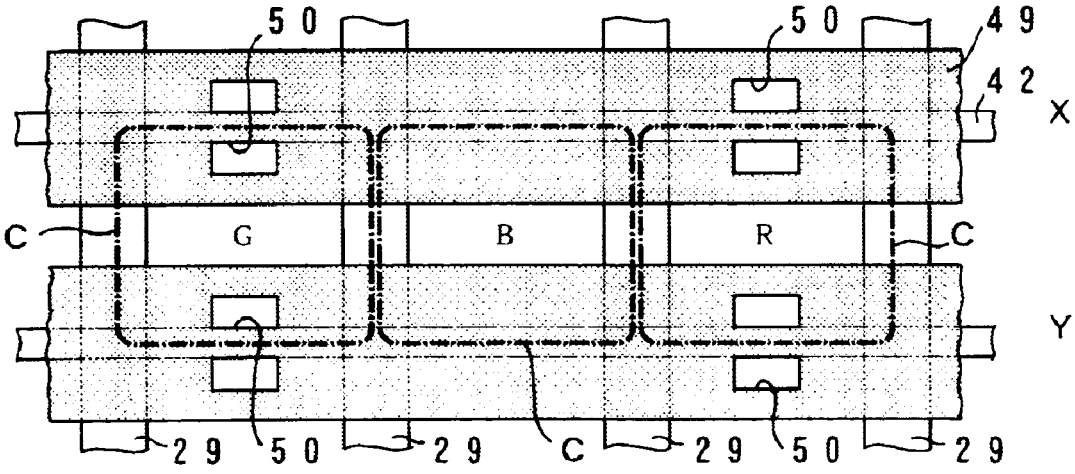

In the example of FIG. 4C, each of the main electrodes X and Y includes a banding metal film 42 and a banding transparent conductive film 49 having a hole 50. By arranging the hole in the cells C of the red light color and the green light color, the effective area of the main electrode in blue light color is relatively enlarged.

Figure 5A:
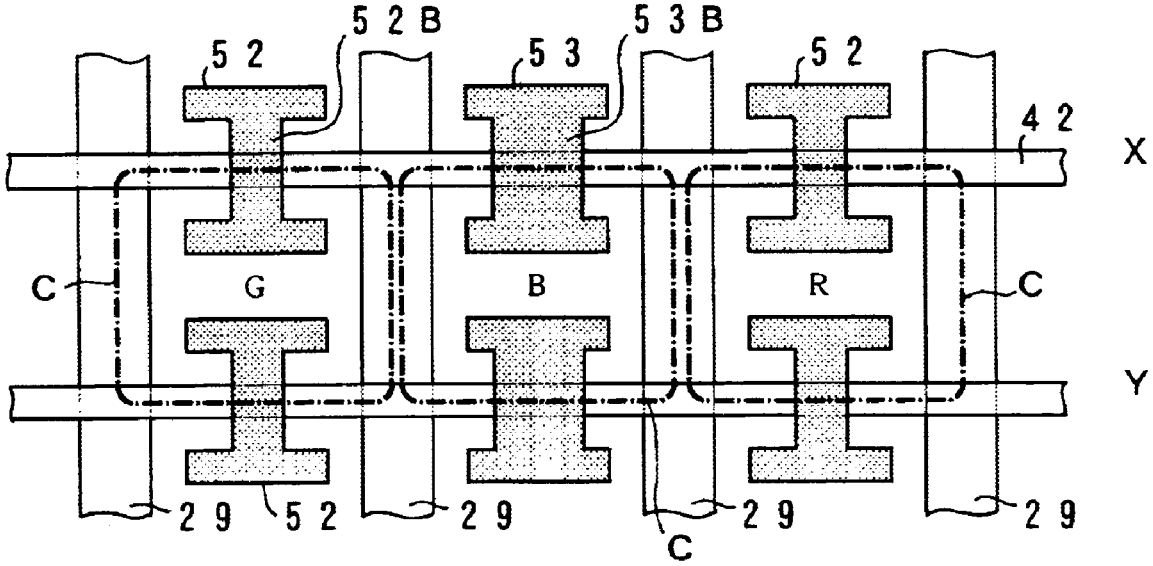

In the example of FIG. 5A, each of the main electrodes X and Y includes a banding metal film 42 and substantially I shaped transparent conductive films 52 and 53. Since the main electrodes X and Y straddle two rows, the portion corresponding to one cell in the transparent conductive films 52 and 53 is substantially T-shaped. Concerning the cell C of blue light color, the portion 53B of the transparent conductive film 53 extending in the column direction is wider than the portion extending in the column direction of the transparent conductive film 52 corresponding to the other cells C, so that the effective area of the main electrode is enlarged.

Figure 5B:
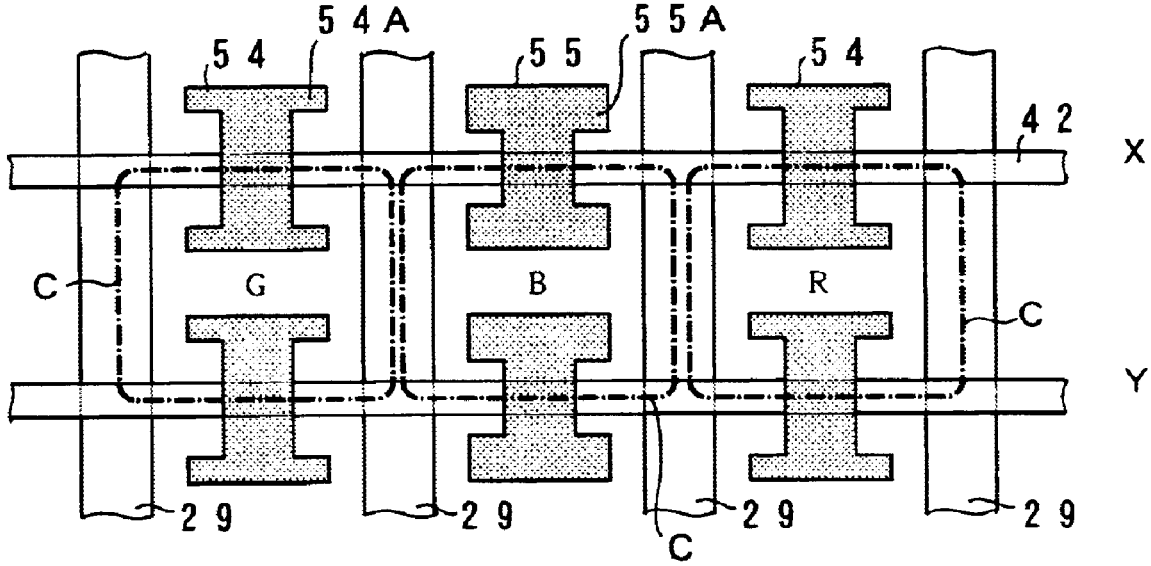

In the example of FIG. 5B, each of the main electrodes X and Y includes a banding metal film 42 and substantially I shaped transparent conductive films 54 and 55. Since the main electrodes X and Y straddle two rows, the portion corresponding to one cell in the transparent conductive films 54 and 55 is substantially T-shaped. Concerning the cell C of blue light color, the portion 55A of the transparent conductive film 54 extending in the row direction is wider than the portion extending in the row direction of the transparent conductive film 54 corresponding to the other cells C, so that the effective area of the main electrode is enlarged.

Both main electrodes X and Y do not always need the enlargement of the electrode area. The enlargement of the electrode area can be realized for either main electrode X or Y. This is true for any example of FIGS. 2–5. If each of the main electrodes X and Y is cut partially in the column direction as shown in FIGS. 4A, 4B and 5, the surface discharge can be localized in the vicinity of the surface discharging gap, so that the resolution can be enhanced. If each of the main electrodes X and Y is shaped such that the main electrode gap is wider than the surface discharging gap d1 periodically along the row direction as shown in FIGS. 3 and 5, the capacitance between the electrodes becomes smaller than that in the case where the main electrode gap is constant over the entire length in the row direction, thereby the driving characteristics are improved. In addition, the electrode area becomes small so that the discharge current decreases. Therefore, the requirement for the current capacity to the driving circuit about the current capacity is relieved. Decrease of the intensity due to the decrease of the discharge current can be compensated by increasing the drive frequency.

The arrangements of the main electrode in the above-mentioned examples are constant pitch arrangements suitable for an interlace format display such as a television set. However, the present invention is not limited thereto. An example of the present invention applied to the electrode arrangement in which a pair of the main electrodes X and Y is arranged for each row will be explained below.

In the constant pitch arrangement, the metal film 42 is disposed at the middle in the width direction of the transparent conductive film 41 so that the cell structure of all rows can be uniform. On the contrary, if a pair of main electrodes X and Y is arranged for each row, the metal film 42 can be disposed at the surface discharging gap side or the opposite side thereof.

Figure 6:
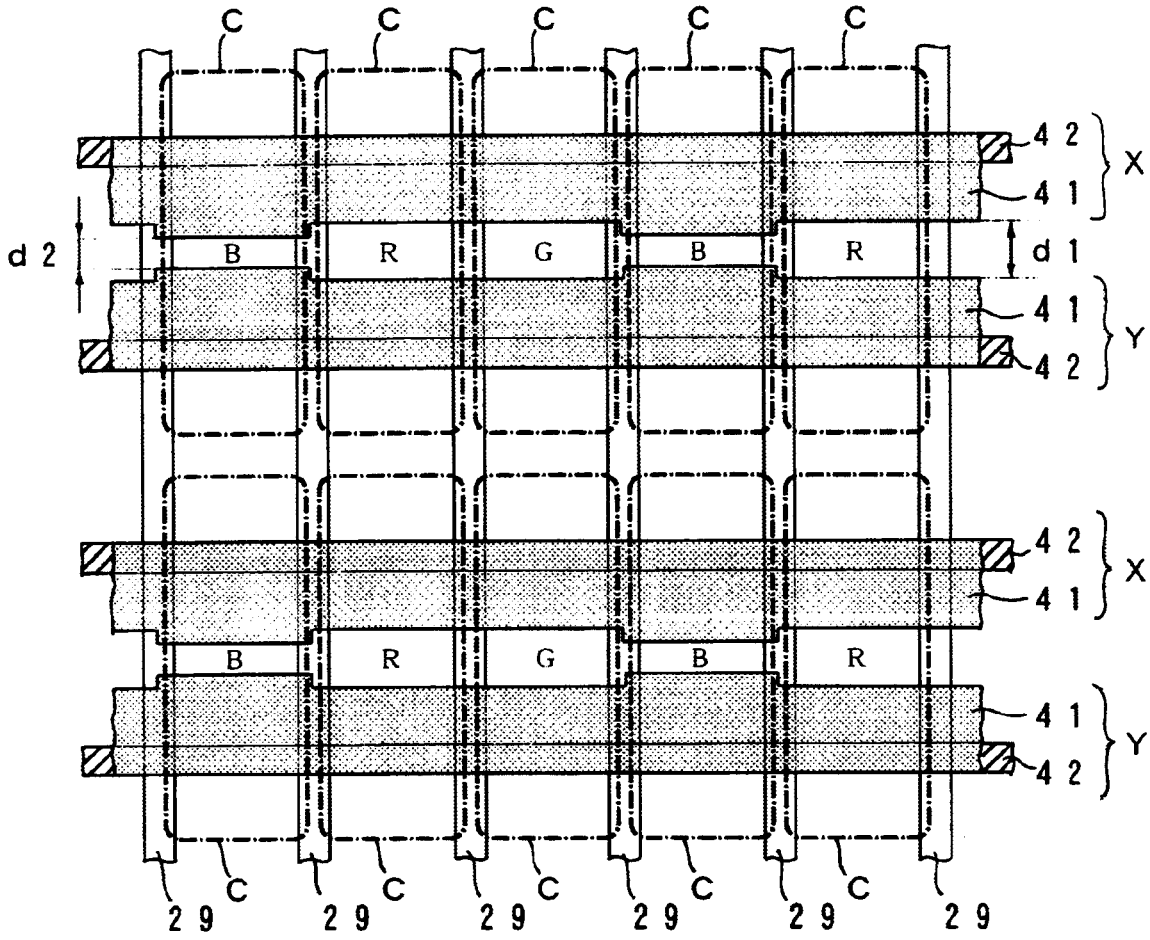

In the example of FIG. 6, the effective area of the main electrode is enlarged in the cell C of the blue light color by partially widening the transparent conductive film 42 so that the surface discharging gap is narrowed in the same way as in the example of FIG. 2.

Figure 7:
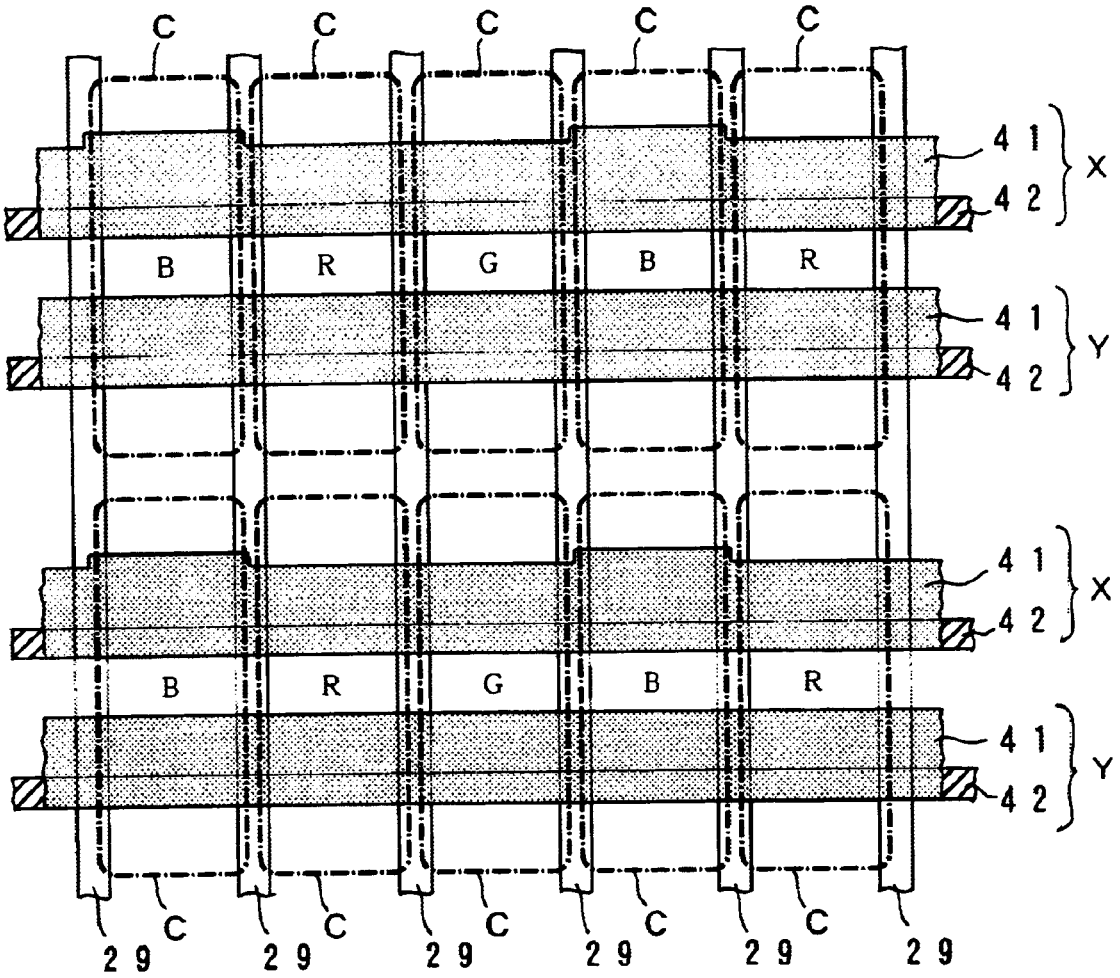

In the example of FIG. 7, the metal film 42 that makes up the main electrode X is disposed at the surface discharging gap side. The transparent conductive film 41 of the main electrode X is partially widened so as to protrude in the direction opposite to the surface discharging gap. Thus, the effective area of the main electrode in the cell C of the blue light color is enlarged.

Figure 8:
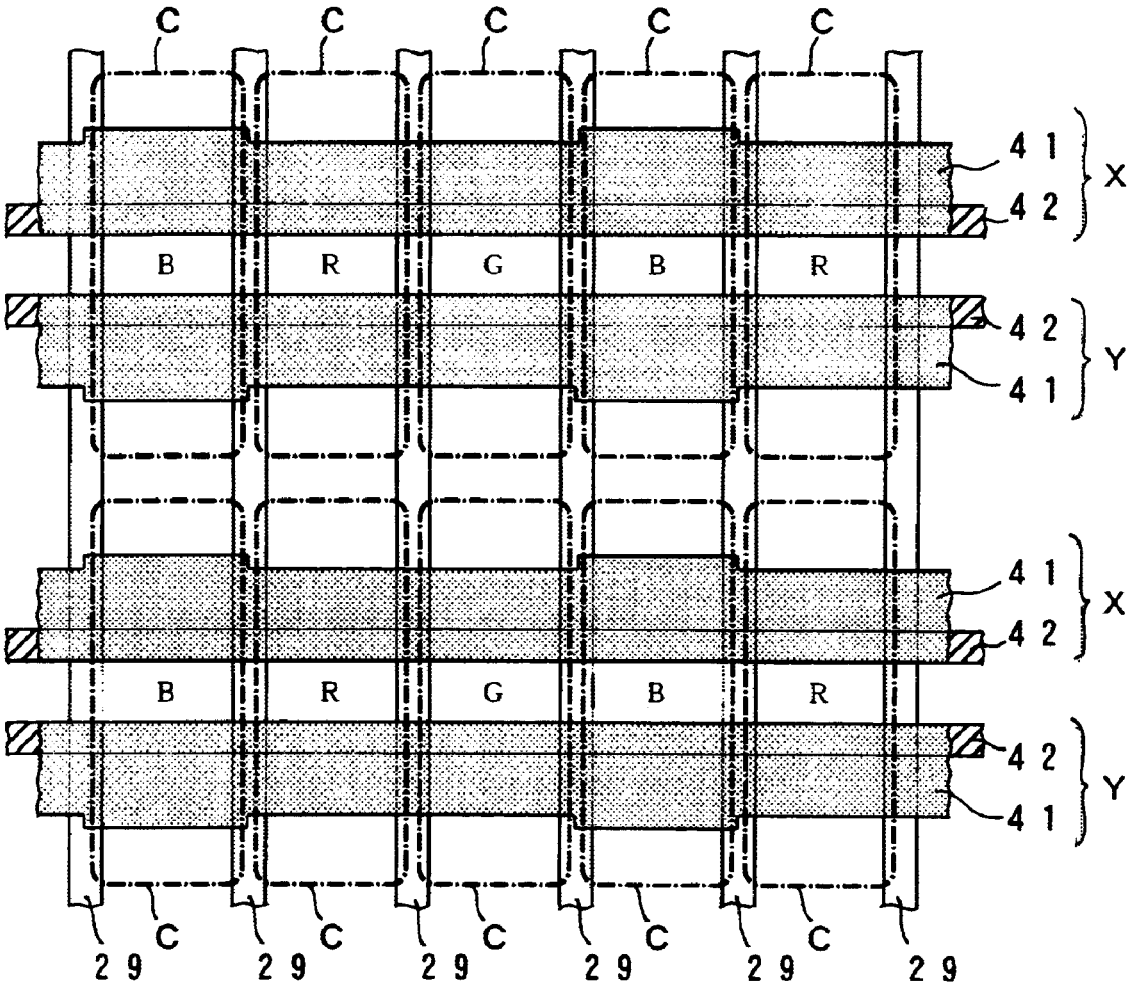

In the example of FIG. 8, the metal film 42 of each of the main electrodes X and Y is disposed at the surface discharging gap side. The transparent conductive film 41 of the main electrodes X and Y is partially widened so as to protrude in the direction opposite to the surface discharging gap. Thus, the effective area of the main electrode in the cell C of the blue light color is enlarged. The shape of the transparent conductive film in the examples of FIGS. 2–5 can be applied to the examples of FIGS. 6–8 also.

Figure 9:
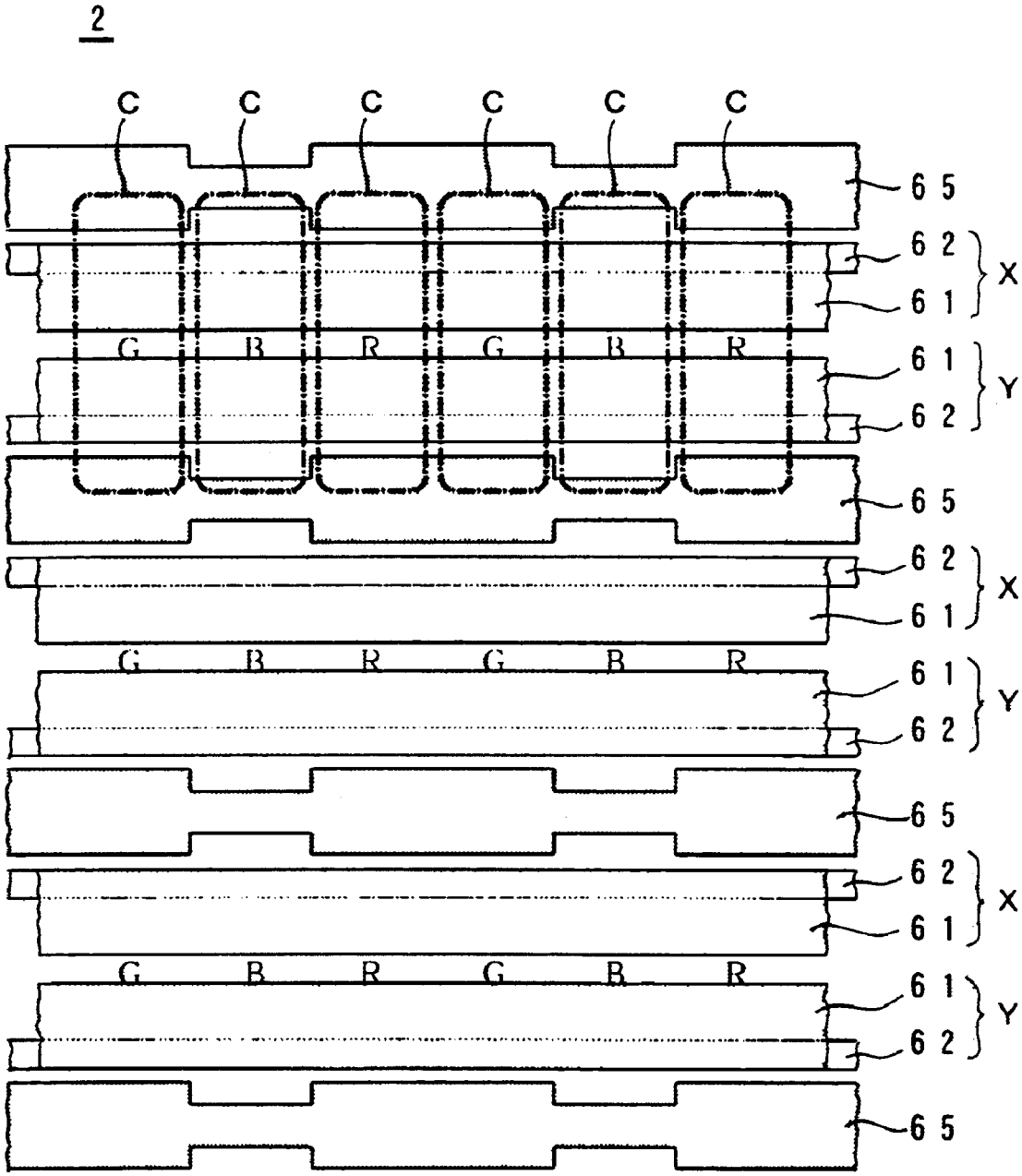
FIG. 9 is a plan view of a principal portion of a second PDP in accordance with the present invention.

FIG. 9 is a plan view of a principal portion of a second PDP in accordance with the present invention.

The PDP 2 also is a reflection type similar to the PDP 1 shown in FIG. 1. The main electrodes X and Y include a transparent conductive film 61 and a metal film 62. The main electrodes X and Y are arranged in inconstant pitch in the same manner as in FIGS. 6–8, in which the interelectrode gap (referred to as an inverse slit) between rows is set to a value sufficiently larger than the surface discharging gap so as to prevent interference with discharge. Both the transparent conductive film 61 and the metal film 62 have a banding shape with a constant width, so that the effective area of the main electrodes X and Y is uniform for all cells C.

In the PDP 2, in order to enhance the contrast, a paint is applied to the outer surface of the glass substrate 11 of the front side (see FIG. 11), or a colored glass layer is formed on the inner surface of the glass substrate 11, so that a banding dark color layer 65 is arranged on the inverse slit. Namely, so-called black stripe is formed so that a whity color of the fluorescent layer 28 on the back glass substrate 21 cannot be seen through the inverse slit. The width of the dark color layer 65 is partially narrowed in the column of blue light color. Thus, the light shield by the dark color layer 65 is relieved in the cells C of blue light color, and the intensity therein is increased compared with other cells C.

Figure 10:
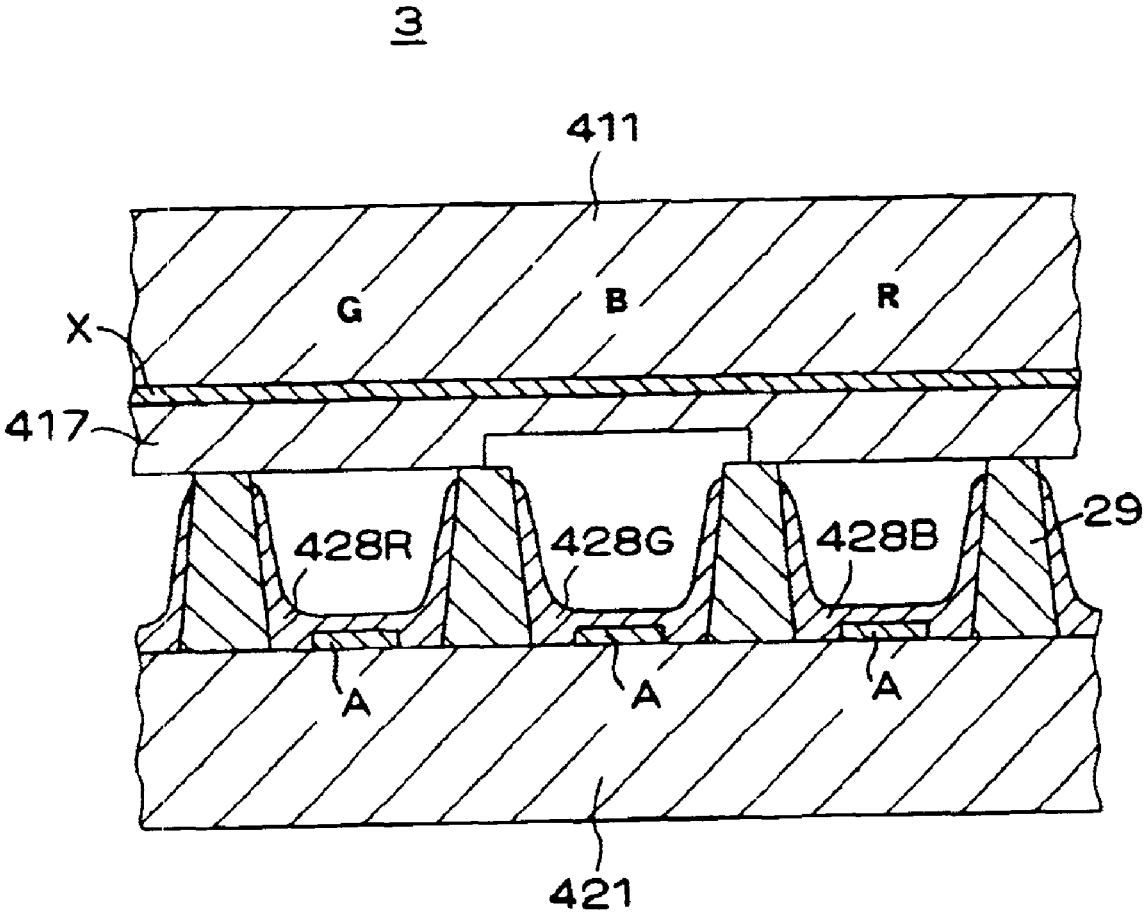
FIG. 10 is a cross section of the principal portion of a third PDP in accordance with the present invention.

FIG. 10 is a cross section of the principal portion of a third PDP in accordance with the present invention.

The PDP 3 of this example is also a surface discharge and reflection type. The inner surface of the front glass substrate 411 is provided with main electrodes X and Y (only main electrode X is illustrated) and a dielectric layer 417. The address electrodes A and the division walls 29 are arranged on the back glass substrate 421, and fluorescent layers 428R, 428G and 428B are formed between the division walls. In the PDP 3, the dielectric layer 417 is thin at the portion corresponding to the cells of blue light color compared with cells of other colors. Therefore, the intensity of electric field is increased in the cells of blue light color so that the discharge is enhanced for high light intensity.

Figure 11:
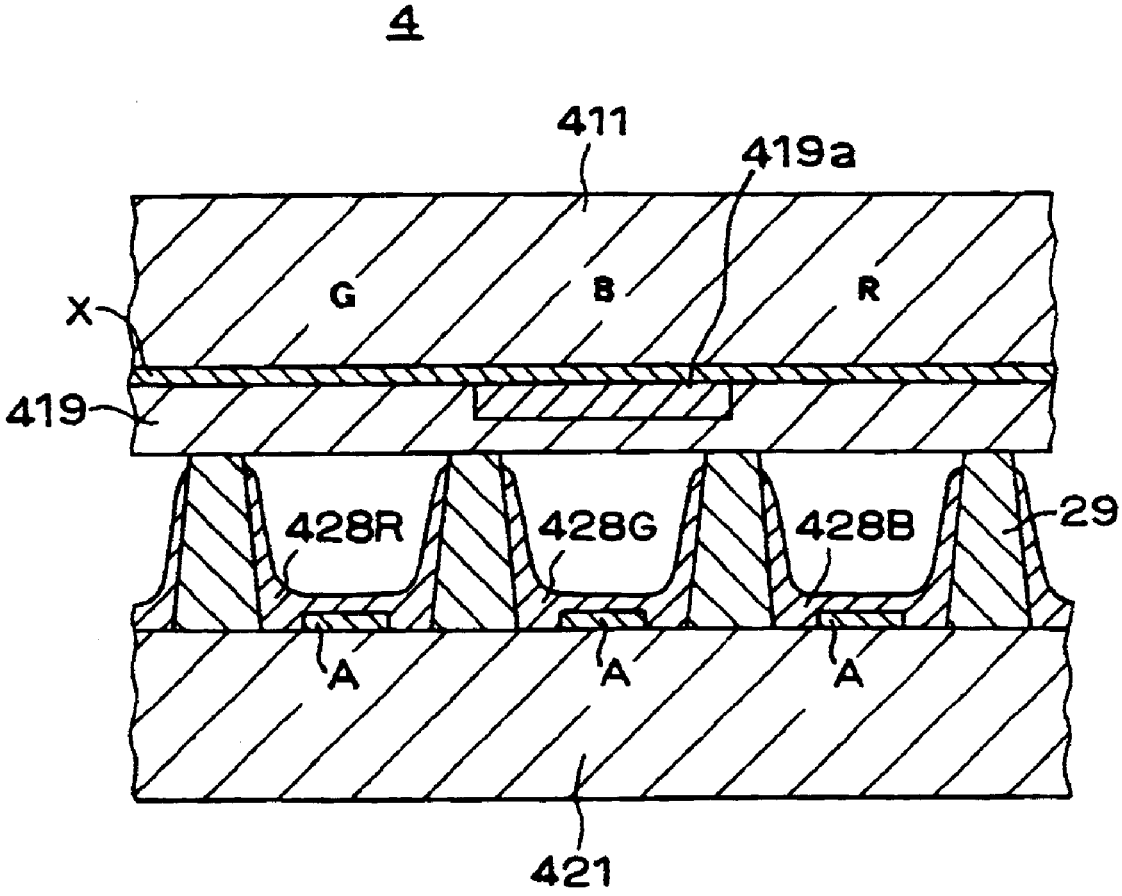
FIG. 11 is a cross section of the principal portion of a fourth PDP in accordance with the present invention.

FIG. 11 is a cross section of the principal portion of a fourth PDP in accordance with the present invention. In FIG. 11, the element corresponding to that in FIG. 10 is denoted by the same reference numeral.

In the PDP 4 of this example too, the inner surface of the front glass substrate 411 is provided with main electrodes X and Y (only main electrode X is illustrated) and a dielectric layer 419. The address electrodes A and the division walls 29 are arranged on the back glass substrate 421, and fluorescent layers 428R, 428G and 428B are formed between the division walls. In the PDP 4, the portion of the dielectric layer 417 corresponding to the cells of blue light color has an embedded layer 419*a* whose relative dielectric constant is larger than other portions. Thus, the discharge current increases to enhance the discharge in the cell of blue light color, so that the light intensity increases. For example, the dielectric layer 419 can be formed by printing the material of the layer 419*a* in the pattern, printing the material of other portion flatly, and baking.

Figure 12:
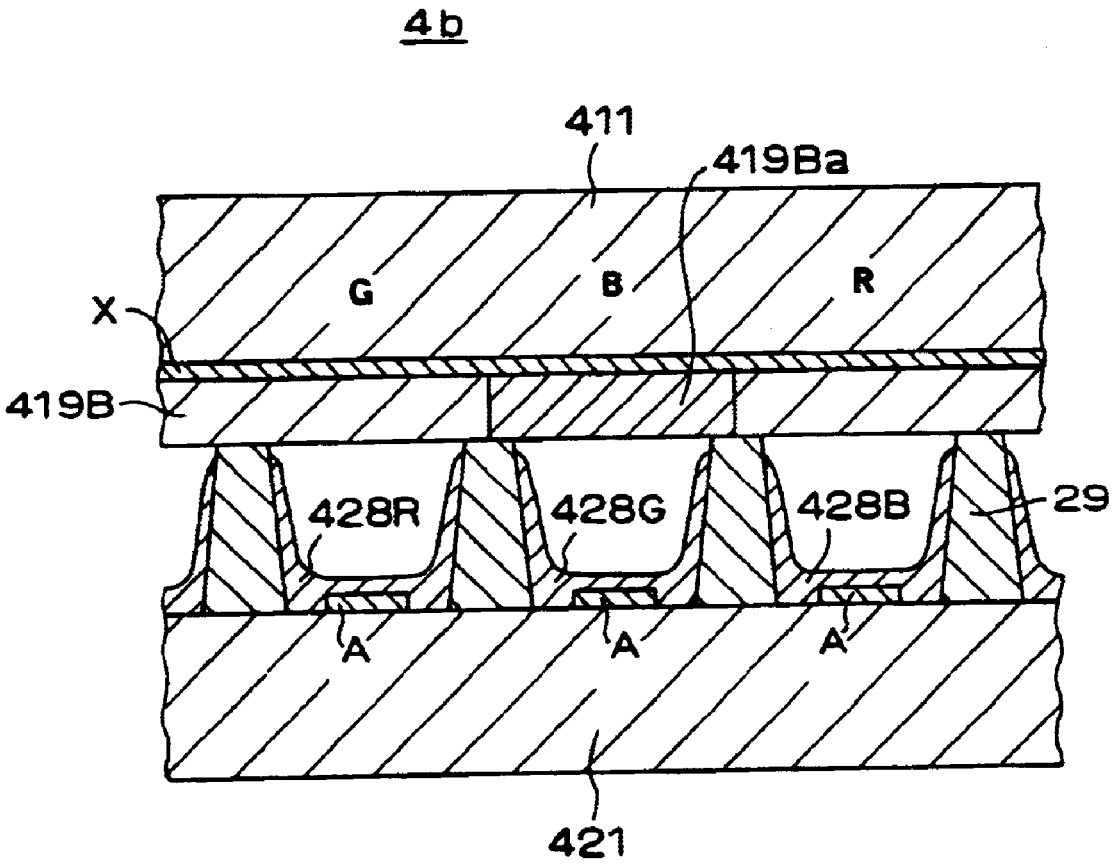
FIG. 12 is a cross section showing a variation of the dielectric layer.

FIG. 12 is a cross section showing a variation of the dielectric layer.

In the PDP 4*b* of FIG. 12, a first dielectric layer 419B is provided to the cells of red or green light colors, while a second dielectric layer 419Ba is provided to the cells of blue light color. The relative dielectric constant of the dielectric layer 419Ba is larger than that of the dielectric layer 419B. The dielectric layers 419B and 419Ba are formed by printing each material in the pattern and baking.

There are other methods for adjusting the relative light intensity. One is to change the distance between the fluorescent layer and the main electrode in accordance with the color. Another is to color the division wall 29 and the back dielectric layer 24, and to change the color or the tone. These methods can be used in conjunction with each of the above-mentioned examples.

Figure 13:
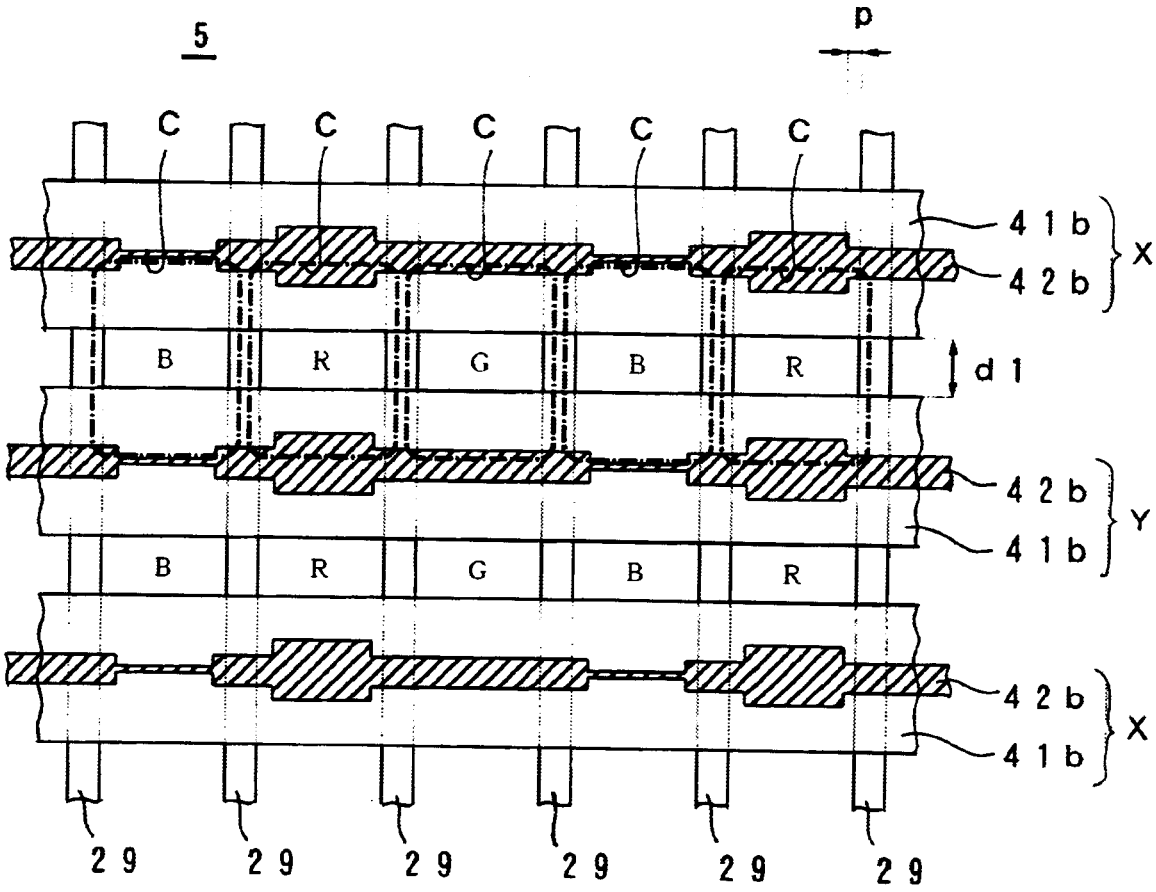
FIG. 13 is a cross section of the principal portion of a fifth PDP in accordance with the present invention.

FIG. 13 is a cross section of the principal portion of a fifth PDP in accordance with the present invention.

The PDP 5 is a reflection type in which the main electrodes X and Y for surface discharge are arranged in the constant pitch in the same way as in FIG. 1. Each of the main electrodes X and Y includes a transparent conductive film 41*b* having a constant width and a metal film 42*b* overlayed thereon at the middle of the width. In the PDP 5, the utilization ratio of visible light for the cell C is adjusted by changing the width of the metal film 42*b* for each light color (R, G or B). The width of the metal film of the cell whose relative intensity is to increase (the cell of blue color if the color temperature should be improved) is narrowed compared with other portion. On the contrary, the width of the metal film of the cell whose relative intensity is not to increase (the cell of blue color) is widened. Thus, the relative intensity can be adjusted without changing the line resistance of the bus conductor. There is no problem even if the value of the metal film 42*b* in each cell is different between the main electrode X and the main electrode Y. The firing potential that is important for controlling the discharge is mainly determined by the transparent conductive film 41*b*, so it cannot be any obstacle to the discharge control. For example, the width Wt of the transparent conductive film 41*b* is set to 275 microns, the arrangement pitch Rp of the division wall 29 is set to 360 microns, the width Wb1 of the metal film 42*b* of the red color cell is set to 140 microns, the width Wb2 of the metal film 42*b* of the green color cell is set to 100 microns, and the width Wb3 of the metal film 42*b* of the blue color cell is set to 60 microns, so that the intensity of the blue color cell whose aperture ratio is increased increases by 11%, while the intensity of the red color cell whose aperture ratio is decreased decreases by 20%. In addition, if there is a difference of structure between the cells arranged in the row direction as shown in this example, there is a possibility that desired characteristics cannot be obtained when a position shift occurs between the front substrate and the back substrate. In order to prevent this occurrence, the distance p between the portion of the metal film 42*b* whose width increases or decreases and the center of the upper face of the division wall 29 can be set to a value more than 5 microns and less than one third of the arrangement pitch Rp, so that a predetermined performance can be obtained by a practical accuracy of positioning.

Figure 14:
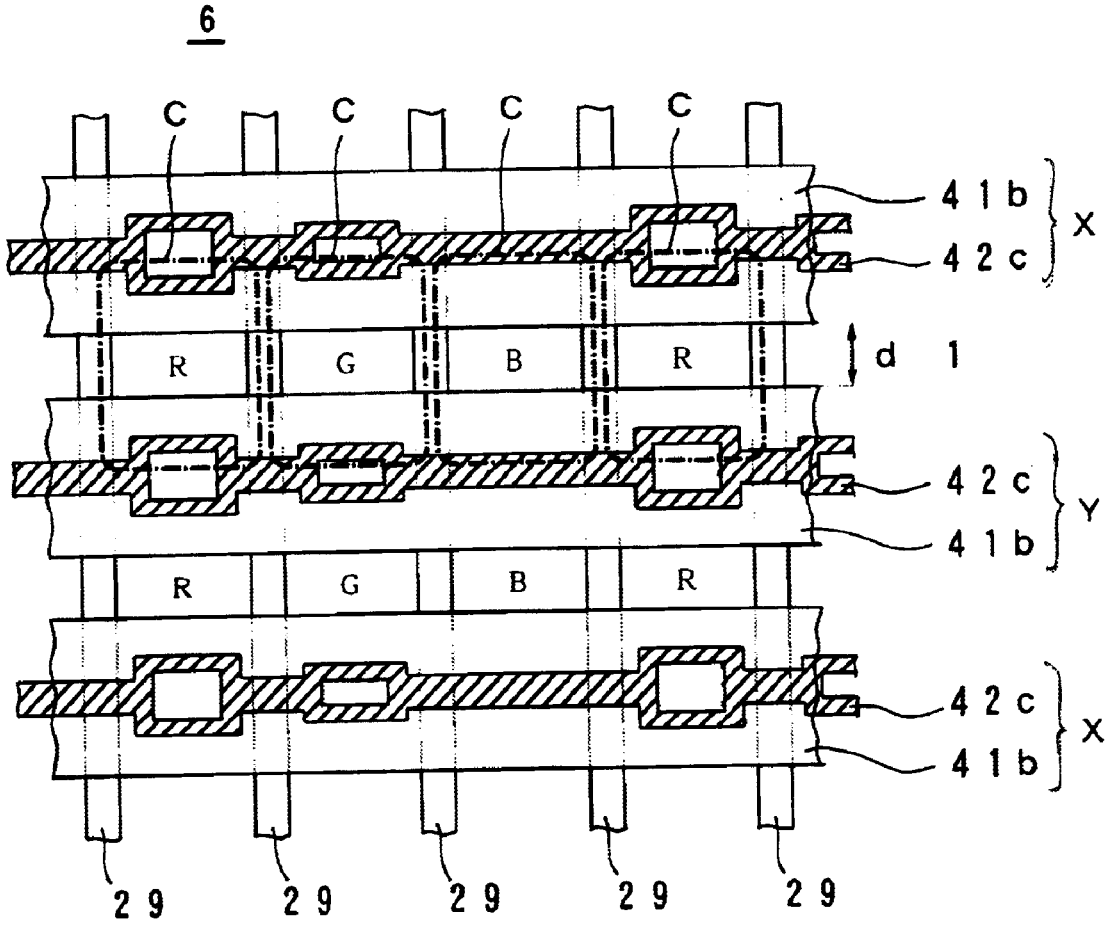
FIG. 14 is a cross section of the principal portion of a sixth PDP in accordance with the present invention.

FIG. 14 is a cross section of the principal portion of a sixth PDP in accordance with the present invention.

In the PDP 6, the relative intensities of red, green and blue colors can be adjusted by selecting the position of the metal film 42*c* on the transparent conductive film 41*b*. In this configuration too, the problem of the firing potential cannot occur in the same way as in FIG. 13.

Figure 15:
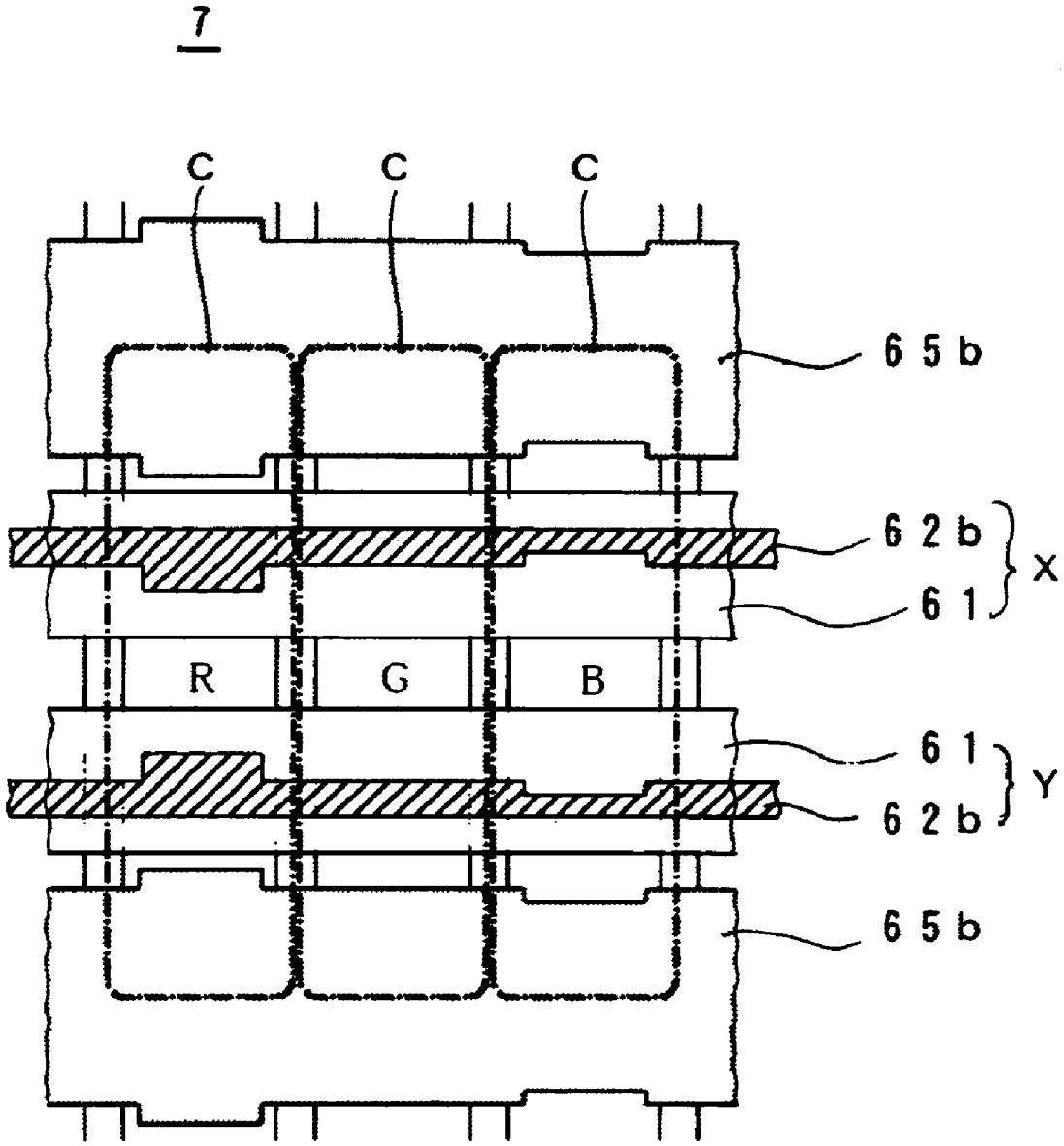
FIG. 15 is a cross section of the principal portion of a seventh PDP in accordance with the present invention.

FIG. 15 is a cross section of the principal portion of a seventh PDP in accordance with the present invention.

The PDP 7 is a reflection type in which the main electrodes X and Y for surface discharge are arranged in inconstant pitch, and include a dark color layer 65*b* for light shield of the inverse slit in the same manner as in FIG. 9. In the PDPd 7, the utilization ratio of visible light for the cell C is adjusted by changing the width of the actual film 62*b* and the width of the dark color layer 65*b* for each light color (R, G or B). If the width of the dark color layer 65*b* is decreased from 350 microns to 175 microns, the intensity can be increased by approximately 11%. The adjustment of the relative intensities by setting the width of the dark color layer 65*b* that does not have electric function has more flexibility than the adjustment by the metal film.

Figure 16:
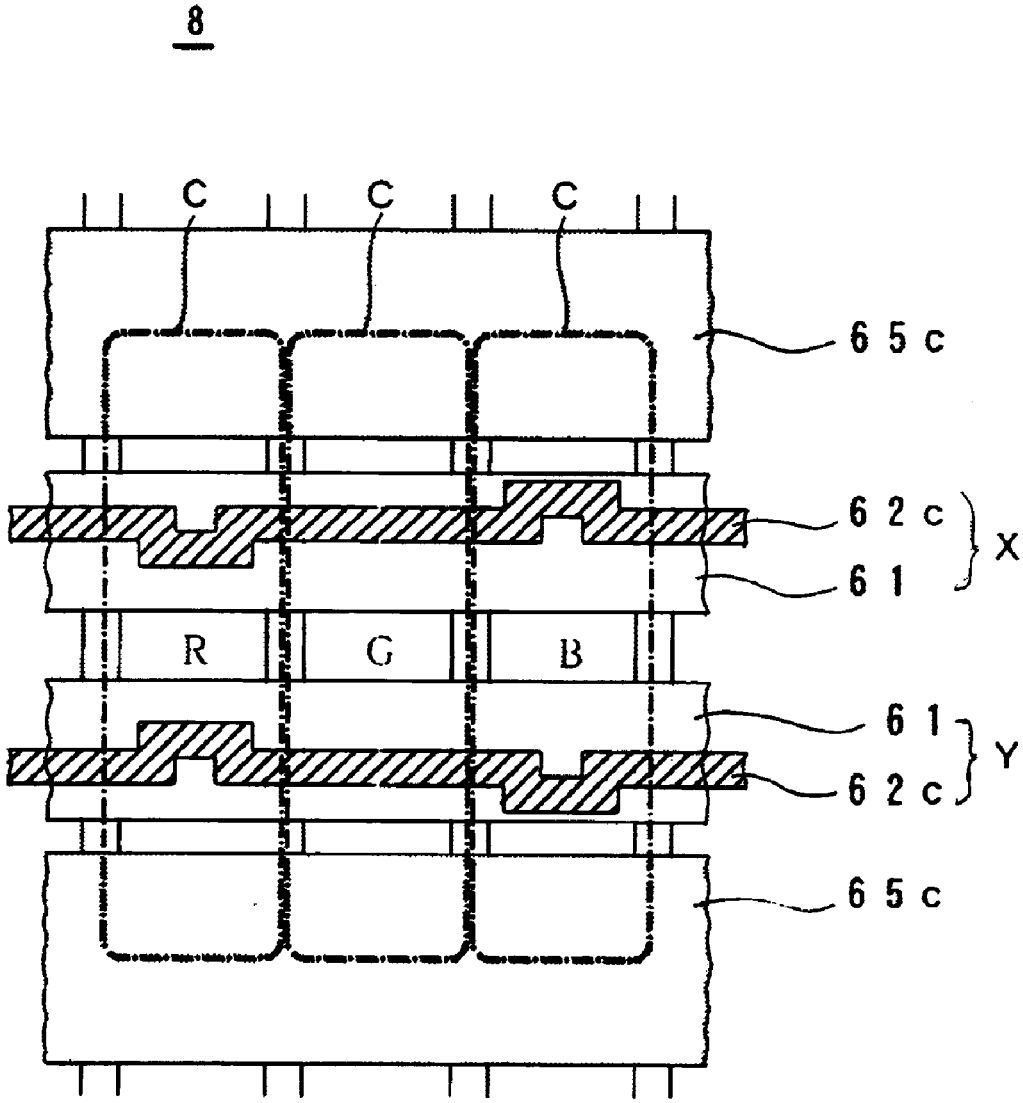
FIG. 16 is a cross section of the principal portion of an eighth PDP in accordance with the present invention.

FIG. 16 is a cross section of the principal portion of an eighth PDP in accordance with the present invention.

In the PDP 8, the position of the metal film 62*c* on the transparent conductive film 61 is selected for adjusting the relative intensity of red, green and blue colors. In this configuration too, the problem of the firing potential cannot occur in the same way as in FIG. 13. In the examples of FIG. 16 as well as the example of FIG. 15, the shapes of the electrodes of the main electrode X and the main electrode Y can be asymmetric.

Figure 17A:
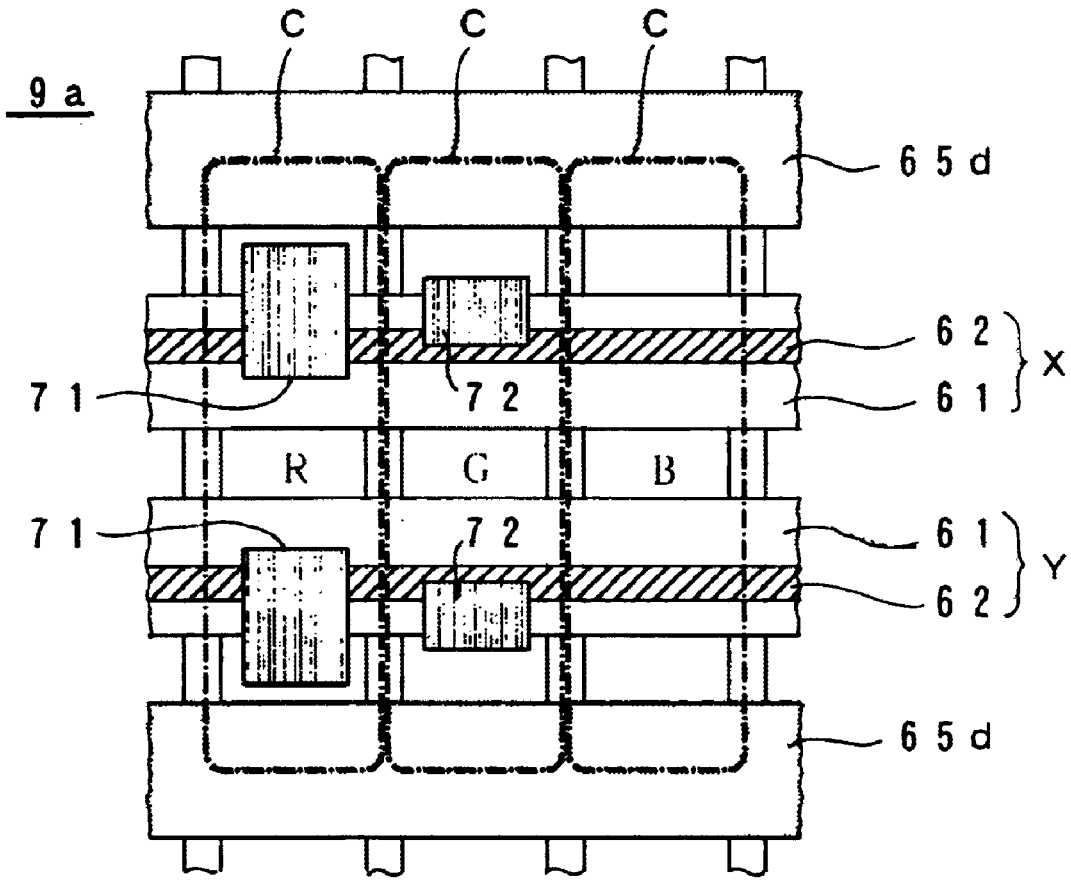
FIGS. 17A and 17B are plan views of the principal portion of a ninth PDP in accordance with the present invention.
Figure 17B:
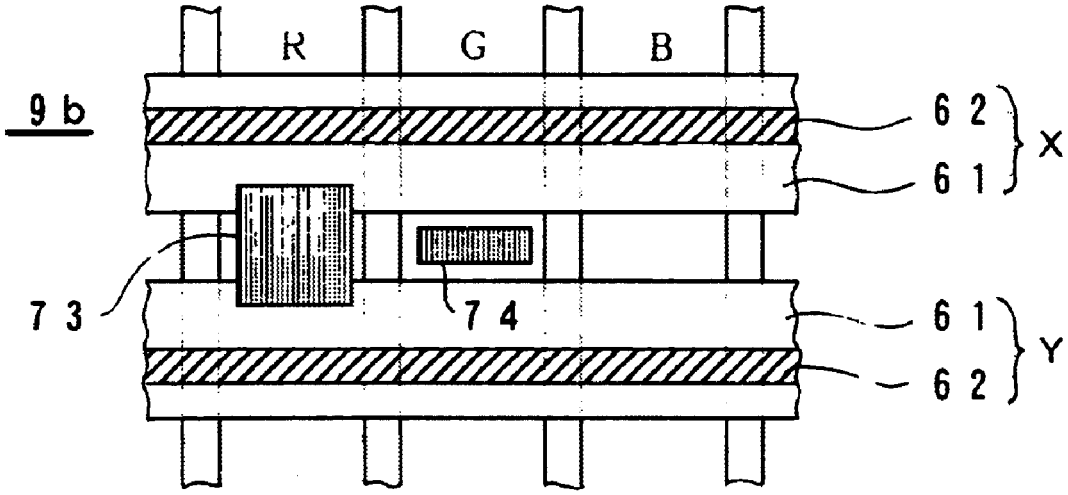

FIGS. 17A and 17B are plan views of the principal portion of a ninth PDP in accordance with the present invention.

In the PDP 9*a* shown in FIG. 17A, adding to the dark color layer 65*d* of the inverse slit, the cells of red color and green color are provided with light shielding films 71 and 72 for adjusting the aperture ratio, which are disposed at the dark color layer 65*d* side. In the PDP 9*b* shown in FIG. 17B, light shielding films 73 and 74 are disposed within the area of the surface discharging gap. The adjustment of the relative intensities by the light shielding films 71–74 has an advantage in that the adjustment range is wide since any shielding area can be selected.

According to the above-mentioned embodiments, the shape of the main electrodes X and Y formed by the photolithography process with high accuracy, the thickness of the dielectric layer that can be controlled relatively easily, or the relative dielectric constant can adjust the discharge intensity or the utilization ratio of visible light for each color independently, so that the adjustment of the light intensity can be performed with high reproducibility and high accuracy. As a result, intensity of blue light that is a weak point of PDPs can be securely increased, so that the color reproducible range can be enlarged and the color temperature of the white color display can be raised.

The present invention is not limited to a reflection type surface discharge format, but can be applied to a transparent type surface discharge format or an opposed discharging format PDP too.

According to the present invention, the color temperature of the displayed color can be optimized while the gradation reproducibility and the stability of driving are secured.

What is claimed is:

1. A plasma display panel, comprising:

a screen in which each of a plurality of cells, arranged in rows and columns, emits light by an electric discharge between a pair of main electrodes, and each pixel of a matrix display has first, second and third cells having respective, different light colors, wherein:

a main electrode has effective areas, which are common, in respective, plural cells having a common light color in the screen, and a respective effective area of the main electrode of the first cell in each pixel is different from a respective effective area of the main electrode of the second cell in each pixel.

2. The plasma display panel according to claim 1, wherein a light color of the first cell in each pixel is blue, a light color of the second cell in each pixel is red, and a light color of the third cell in each pixel is green, and the respective effective area of the main electrode of the first cell in each pixel is larger than each of the respective effective area of the main electrode of the second cell in each pixel and a respective effective area of the main electrode of the third cell in each pixel.

3. A plasma display panel, comprising:

a screen in which each of a plurality of cells, arranged in rows and columns, emits light by an electric discharge between a pair of main electrodes that is covered by a dielectric layer, and each pixel of a matrix display has first, second and third cells having respective, different light colors, wherein:

a thickness of the dielectric layer of the first cell in each pixel is different from a thickness of the dielectric layer of the second cell in each pixel.

4. The plasma display panel according to claim 3, wherein a light color of the first cell in each pixel is blue, a light color of the second cell in each pixel is red, and a light color of the third cell in each pixel is green, and the thickness of the dielectric layer of the first cell in each pixel is smaller than each of the thickness of the dielectric layer of the second cell in each pixel and a thickness of the dielectric layer of the third cell in each pixel.

5. A plasma display panel, comprising:

a screen in which each of a plurality of cells, arranged in rows and columns, emits light by an electric discharge between a pair of main electrodes that is covered by a dielectric layer, and each pixel of a matrix display has first, second and third cells having respective, different light colors, wherein:

a dielectric constant of the dielectric layer of the first cell in each pixel is different from a dielectric constant of the dielectric layer of the second cell in each pixel.

6. The plasma display panel according to claim 5, wherein a light color of the first cell in each pixel is blue, a light color of the second cell in each pixel is red, and a light color of the third cell in each pixel is green, and the dielectric constant of the dielectric layer of the first cell in each pixel is larger than each of the dielectric constant of the dielectric layer of the second cell in each pixel and a dielectric constant of the dielectric layer of the third cell in each pixel.

7. A plasma display panel, comprising:

a screen in which each of a plurality of cells, arranged in rows and columns, emits light by an electric discharge between a pair of main electrodes that extend in a same direction, and each pixel of a matrix display has first, second and third cells having respective, different light colors, wherein one pair of the main electrodes is arranged for each row;

neighboring rows, each having a respective boundary therebetween; and a light shielding layer enhancing contrast is disposed at each respective boundary between the neighboring rows, a light intensity of the first cell in each pixel is smaller than each of a light intensity of the second cell in each pixel and a light intensity of the third cell in each pixel, and the light shielding layer has a shape such that an aperture area of the first cell in each pixel is larger than teach of an aperture area of the second cell in each pixel and an aperture area of the third cell in each pixel, an area of the light shielding layer of the first cell in each pixel is different from an area of the light shielding layer of the second cell in each pixel to change the light intensity of the first cell in each pixel relative to the light intensity of the second cell in each pixel.

8. The plasma display panel according to claim 7, wherein a light color of the first cell in each pixel is blue, a light color of the second cell in each pixel is red, and a light color of the third cell in each pixel is green.

9. A plasma display panel, comprising:

a screen in which each of a plurality of cells, arranged in rows and columns, emits light by an electric discharge between a pair of main electrodes that extend in a same direction, and each pixel of a matrix display has first, second and third cells having respective, different light colors, wherein each of the main electrodes includes a transparent conductive film and a banding metal film overlaying the transparent conductive film, and an area of the banding metal film of the first cell in each pixel is different from an area of the banding metal film of the second cell in each pixel.

10. The plasma display panel according to claim 9, wherein division walls partitioning the first, second and third cells are provided on a back substrate, and an amount of light shielding for each light color is set by selecting a structure of the light shielding within a distance of 5 microns away from a top face of the division wall in each of the first, second and third cells.

11. The plasma display panel according to claim 9, wherein a light color of the first cell in each pixel is blue, a light color of the second cell in each pixel is red, and a light color of the third cell in each pixel is green, and the area of the banding metal film of the first cell in each pixel is larger than each of the area of the banding metal film of the second cell in each pixel and an area of the banding metal film of the third cell in each pixel.

12. A plasma display panel, comprising:

a screen in which each of a plurality of cells, arranged in rows and columns, emits light by an electric discharge between a pair of main electrodes that extend in a same direction, and each pixel of a matrix display has first, second and third cells having respective, different light colors, wherein each of the main electrodes includes a transparent conductive film and a banding metal film overlaying the transparent conductive film, and a relative portion of the banding metal film to the transparent conductive film of the first cell in each pixel is different from a relative portion of the banding metal film to the transparent conductive film of the second cell in each pixel.

13. The plasma display panel according to claim 12, wherein division walls partitioning the first, second and third cells are provided on a back substrate, and an amount of light shielding for each light color is set by selecting a structure of the light shielding within a distance of 5 microns away from a top face of the division wall in each of the first, second and third cells.

14. A plasma display panel, comprising:

a screen in which each of a plurality of cells, arranged in rows and columns, emits light by an electric discharge between a pair of main electrodes that extend in a same direction, and each pixel of a matrix display has first, second and third cells having respective, different light colors, wherein the first cell in each pixel has a light shield that makes an aperture ratio thereof different from an aperture ratio of another cell in each pixel, an area of the light shield of the first cell in each pixel is different from an area of a light shield of the second cell in each pixel to change a light intensity of the first cell in each pixel relative to a light intensity of the second cell in each pixel.

15. The plasma display panel according to claim 14, wherein division walls partitioning the first, second and third cells are provided on a back substrate, and an amount of light shielding for each light color is set by selecting a structure of the light shielding within a distance of 5 microns away from a top face of the division wall in each of the first, second and third cells.

16. A plasma display panel, comprising:

a screen in which each of a plurality of cells, arranged in rows and columns, emits light by an electric discharge between a pair of main electrodes that extend in a same direction, and each pixel of a matrix display has first, second and third cells having respective, different light colors, wherein each of the main electrodes includes a transparent conductive film and a banding metal film overlaying the transparent conductive film, and one pair of the main electrodes is arranged for each row;

neighboring rows, each having a respective boundary therebetween; and a dark color layer enhancing contrast is disposed at each respective boundary between the neighboring rows, an area of the banding metal film of the first cell in each pixel is different from an area of the banding metal film of the second cell in each pixel, and an area of the dark color layer of the first cell in each pixel is different from an area of the dark color layer of the second cell in each pixel.

17. The plasma display panel according to claim 16, wherein division walls partitioning the first, second and third cells are provided on a back substrate, and an amount of light shielding for each light color is set by selecting a structure of the light shielding within a distance of 5 microns away from a top face of the division wall in each of the first, second and third cells.

18. A plasma display panel, comprising:

a screen including a plurality of cells arranged in rows and columns to emit light by electric discharges;

a pair of main electrodes arranged for each of the rows;

a plurality of pixels, each pixel defined by first, second and third adjacent cells of the plurality of cells, and the first, second and third adjacent cells having respective, different light colors; and each pair of main electrodes having effective areas, which are common, in all cells having a common light color in the screen, and a respective effective area of the pair of main electrodes of the first cell of each of the pixels is different from a respective effective area of the pair of main electrodes of the second cell of each of the pixels.

19. A plasma display panel including a plurality of cells arranged in rows and columns, each cell to emit light by an electric discharge and the plurality of cells arranged in a plurality of pixels, each pixel defined by plural adjacent cells having respective, different light colors, comprising:

a pair of main electrodes that is covered by one or more dielectric layers and provided for each of the rows; and a thickness or a dielectric constant of the one or more dielectric layers of a first cell of the adjacent cells in each of the pixels is different from a thickness or a dielectric constant of the one or more corresponding dielectric layers of a second cell of the adjacent cells in each of the pixels to change an intensity of an electric discharge in the first cell in each of the pixels relative to an intensity of an electric discharge in the second cell in each of the pixels.

20. A plasma display panel including a plurality of cells arranged in rows and columns, each cell to emit light by an electric discharge and the plurality of cells arranged in a plurality of pixels, each pixel defined by plural adjacent cells having respective, different light colors, comprising:

respective boundaries arranged between adjacent rows; and a light shielding layer enhancing contrast disposed at each of the respective boundaries, and an area of the light shielding layer of a first cell of the adjacent cells in each of the pixels is different from an area of the light shielding layer of a second cell of the adjacent cells in each of the pixels to change a light intensity of the first cell in each of the pixels relative to a light intensity of the second cell in each of the pixels.

21. A plasma display panel including a plurality of cells arranged in rows and columns, each cell to emit light by an electric discharge and the plurality of cells arranged in a plurality of pixels, each pixel defined by plural adjacent cells having respective, different light colors, comprising:

a pair of main electrodes provided for each of the rows, each said pair of main electrodes including a transparent conductive film and a banding metal film overlaying the transparent conductive film, and an area of the banding metal film, or a relative portion of the banding metal film to the transparent conductive film of a first cell of the adjacent cells in each of the pixels is different from an area of the banding metal film, or a relative portion of the banding metal film to the transparent conductive film of a second cell of the adjacent cells in each of the pixels to change a light intensity of the first cell in each of the pixels relative to a light intensity of the second cell in each of the pixels.

22. A plasma display panel including a plurality of cells arranged in rows and columns, each cell to emit light by an electric discharge and the plurality of cells arranged in a plurality of pixels, each pixel defined by plural adjacent cells having respective, different light colors, comprising:

a pair of main electrodes provided for each of the rows, each said pair of main electrodes including a transparent conductive film and a banding metal film overlaying the transparent conductive film;

respective boundaries arranged between adjacent rows; and a dark color layer enhancing contrast disposed at each of the respective boundaries, and an area of the banding metal film, or a relative portion of the banding metal film to the transparent conductive film of a first cell of the adjacent cells in each of the pixels is different from an area of the banding metal film, or a relative portion of the banding metal film to the transparent conductive film of a second cell of the adjacent cells in each of the pixels, and a dark color layer of the first cell in each of the pixels is different from a dark color layer of the second cell in each of the pixels to change a light intensity of the first cell in each of the pixels relative to a light intensity of the second cell in each of the pixel.

23. A plasma display panel, comprising:

a screen in which each of a plurality of cells, arranged in rows and columns, emits light by an electric discharge between a pair of main electrodes, and each pixel of a matrix display has first, second and third cells having respective, different light colors, wherein:

the first, second and third cells corresponding to each pixel are equal in size, a main electrode has effective areas, which are common, in respective, plural cells having a common light color in the screen, and a respective effective area of the main electrode of the first cell in each pixel is different from a respective effective area of the main electrode of the second cell in each pixel.

24. A plasma display panel, comprising:

a screen in which each of a plurality of cells, arranged in rows and columns, emits light by an electric discharge between a pair of main electrodes, plural pairs of the main electrodes defining rows in the screen, and each pixel of a matrix display has first, second and third cells having respective, different light colors, and the main electrodes arranged at regular intervals, and neighboring main electrodes among the main electrodes making respective, plural pairs of the main electrodes for surface discharges, wherein:

each of the main electrodes has effective areas, which are common, in respective, plural cells having a common light color in the screen, and a respective effective area of the main electrode of the first cell in each pixel is different from a respective effective area of the main electrode of the second cell in each pixel.

25. The plasma display panel according to claim 24, wherein each of the main electrodes includes a banding metal film, first and second transparent conductive films that extend in parallel with opposite sides of the banding metal film, and a third transparent conductive film that connects the banding metal film to each of the first and second transparent conductive films, and an area of the third transparent conductive film of the first cell in each pixel is different from an area of the third transparent conductive film of the second cell in each pixel.

26. The plasma display panel according to claim 25, wherein the third transparent conductive film is band-like and a width of the third transparent conductive film is different between the first cell in each pixel and the second cell in each pixel.

* * * * *

UNITED STATES PATENT AND TRADEMARK OFFICE

CERTIFICATE OF CORRECTION

PATENT NO. : 7,071,621 B1
APPLICATION NO. : 09/460459
DATED : July 4, 2006
INVENTOR(S) : Fumihiro Namiki et al.

It is certified that error appears in the above-identified patent and that said Letters Patent is hereby corrected as shown below:

Column 10, Line 63, change “teach” to --each--.

Column 11, Line 34, change “larger” to --smaller--.

Signed and Sealed this

Ninth Day of January, 2007

JON W. DUDAS
*Director of the United States Patent and Trademark Office*